US007689134B2

(12) United States Patent
Inukai

(10) Patent No.: US 7,689,134 B2
(45) Date of Patent: Mar. 30, 2010

(54) IMAGE FORMING APPARATUS HAVING A UNIT FOR DETECTING A CONTACT STATE WITH AN IMAGE FORMING CARTRIDGE

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 660 days.

(21) Appl. No.: 11/586,575

(22) Filed: Oct. 26, 2006

(65) Prior Publication Data

US 2007/0092270 A1 Apr. 26, 2007

(30) Foreign Application Priority Data

Oct. 26, 2005 (JP) ..... 2005-311612

(51) Int. Cl.
*G03G 15/00* (2006.01)

(52) U.S. Cl. ..... 399/13; 399/88

(58) Field of Classification Search ..... 399/13, 399/88

See application file for complete search history.

(56) References Cited

U.S. PATENT DOCUMENTS

2001/0036370 A1* 11/2001 Inoue ..... 399/9

FOREIGN PATENT DOCUMENTS

| | | |
|---|---|---|
| JP | 5-303456 | 11/1993 |
| JP | 6-64278 | 3/1994 |
| JP | 6-339051 | 12/1994 |
| JP | 9-28060 | 1/1997 |
| JP | 2001-83778 | 3/2001 |

* cited by examiner

*Primary Examiner*—David M Gray
*Assistant Examiner*—Ruth N Labombard
(74) *Attorney, Agent, or Firm*—Banner & Witcoff, Ltd.

(57) ABSTRACT

In the image forming apparatus, a developing bias in a developing unit is supplied from a drive electrode on the main body side of the apparatus to an electrode member as a DEV output. A detect electrode is also in contact with the electrode member from the apparatus main body side, while the electric potential of the detect electrode is input to a control part through an A/D converter. The control part, based on the electric potential, controls the DEV output so that the electric potential can coincide with a desired electric potential, and when the electric potential is less than a given value, the control part judges that an abnormal condition such as poor contact has occurred.

7 Claims, 15 Drawing Sheets

IMAGE FORMING APPARATUS HAVING A UNIT FOR DETECTING A CONTACT STATE WITH AN IMAGE FORMING CARTRIDGE

CROSS REFERENCE TO RELATED APPLICATION

This application claims priority from Japanese Patent Application No. 2005-311612, filed on Oct. 26, 2005, the entire subject matter of which is incorporated herein by reference.

TECHNICAL FIELD

Aspects of the present invention relate to an image forming apparatus including an image forming unit which forms an image according to an electrophotographic method and an image forming cartridge constituting at least part of the image forming unit and mountable onto and removable from the main body of the image forming apparatus, and an image forming cartridge mountable onto and removable from an image forming apparatus for forming an image according to an electrophotographic method.

BACKGROUND

Hitherto, in an image forming apparatus for forming an image according to an electrophotographic method, a cartridge for supporting an image carrier such as a photosensitive drum on the surface of which an electrostatic latent image can be formed, and a cartridge for supporting a developing unit such as a developing roller or the like for developing the electrostatic latent image using a developer, or a cartridge composed of an integrated combination of the two cartridges (which are hereinafter generally referred to as an image forming cartridge) are structured such that they can be mounted onto and removed from the main body of the image forming apparatus. Since these image forming cartridges are structured so as to be mountable onto and removable from the apparatus main body, the image forming cartridge can be replaced according to the life spans of the photosensitive drum, developing roller and the like and thus the image forming apparatus can be used continuously.

Also, in this type of image forming apparatus, there is proposed a technology in which power is supplied through a slip ring to a cleaning electro-conductive brush for removing toner left on the surface of the photosensitive drum, and a shunt resistor for monitoring the power supply state is connected in series to an electric circuit reaching the slip ring (for example, see JP-A-9-28060). In such an apparatus, a meter relay, a sequencer and an alarm device in this particular order are connected in series to the shunt resistor and, when the output voltage of the shunt resistor falls below a normal level, a signal is sent to the alarm device.

Further, in this type of image forming apparatus, there is proposed a technology in which a voltage dividing resistor is connected to the power receiving terminal of the image forming cartridge. The divided voltage thereof is converted to digital data and is read into a CPU, where it is checked whether a voltage is applied to the power receiving terminal or not, that is, whether the power receiving terminal is connected to a high voltage supply terminal or not (for example, see JP-A-2001-83778).

SUMMARY

However, in the technologies disclosed in JP-A-9-28060 and JP-A-2001-83778, only poor contacts of the contact portions is monitored and thus, in order to control the voltage, a control circuit becomes necessary. The special provision of the voltage control circuit complicates the structure of the apparatus and thus increases the manufacturing cost thereof.

Aspects of the invention provide an image forming apparatus and an image forming cartridge, which not only can detect an abnormal condition such as the poor contact but also can control the voltage using a simple structure.

DETAILED DESCRIPTION

<General Overview>

Figure 1:
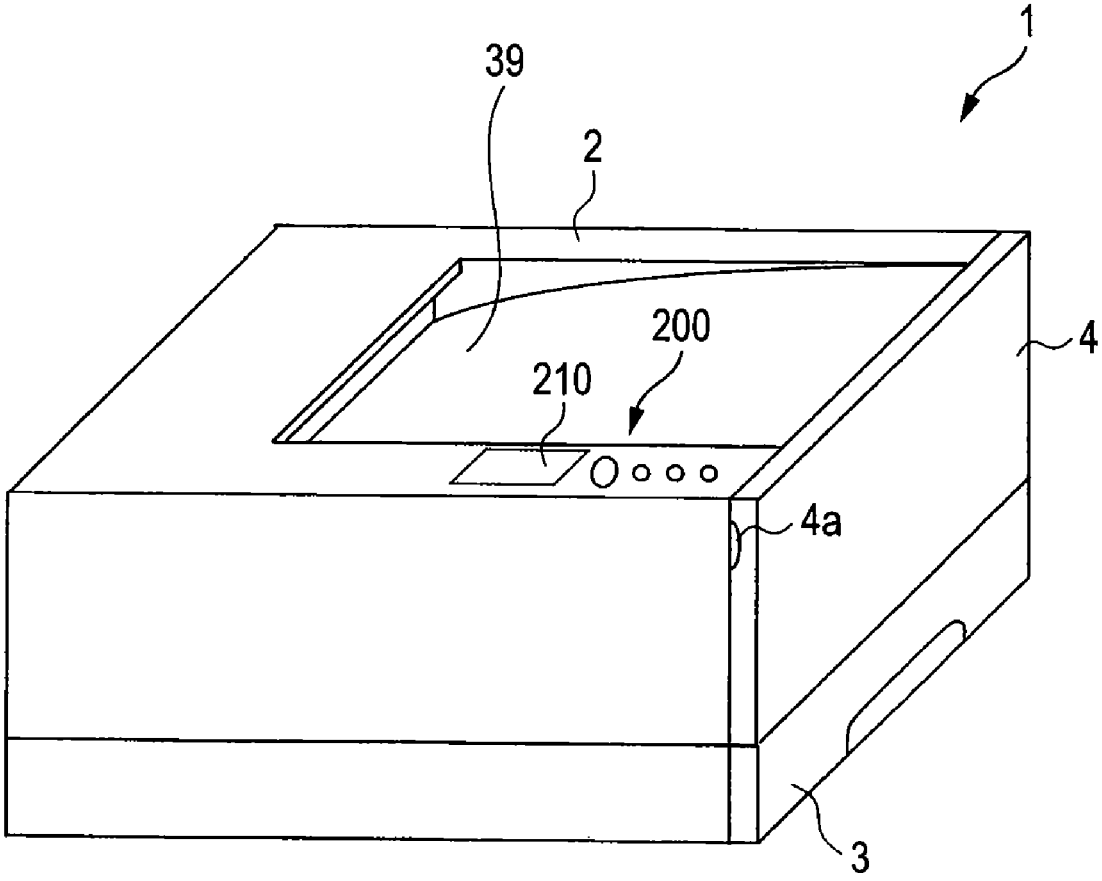
FIG. 1 is a perspective view of the appearance of a laser printer according to an aspect of the present invention.

According to a first aspect of the invention, there is provided an image forming apparatus, comprising: an image forming unit which forms an image electrophotographically; an image forming cartridge which constitutes at least a part of the image forming unit and is removably installable to an image forming apparatus main body; a pair of drive electrodes respectively provided in the image forming apparatus main body and the image forming cartridge, the pair of drive electrodes is contacted with each other so as to allow a bias voltage to be supplied from the image forming apparatus main body to the image forming cartridge when the image forming cartridge is mounted on the image forming apparatus main body; a power supply which is provided in the image forming apparatus main body and applies a voltage to the drive electrode provided in the image forming apparatus main body; a detect electrode which is provided in the image forming apparatus main body separately from the drive electrode of the image forming apparatus main body, the detect electrode being contacted with at least one of the drive electrode of the image forming cartridge and a second electrode on the image forming cartridge which is electrically connected to the drive electrode of the image forming cartridge when the image forming cartridge is mounted on the image forming apparatus main body; a control unit which controls an output of the power supply based on a voltage of the detect electrode; and an abnormal condition detect unit which detects an abnormal condition of the image forming cartridge when the voltage of the detect electrode is abnormal.

In the thus structured image forming apparatus of the invention, the pair of drive electrodes respectively disposed in the image forming apparatus main body and image forming cartridge can be contacted with each other when the image forming cartridge is mounted on the image forming apparatus main body to thereby allow a bias voltage to be applied from the image forming apparatus main body to the image forming cartridge. Also, the power supply disposed in the image forming apparatus main body applies a voltage to the drive electrode of the image forming apparatus main body. Therefore, when the image forming cartridge is mounted on the image forming apparatus main body, the power supply is able to supply a bias voltage to the image forming cartridge through the pair of drive electrodes.

Also, in the present image forming apparatus main body, there is provided a detect electrode in such a manner that the detect electrode is separate from the drive electrode. The detect electrode, when the image forming cartridge is mounted on the image forming apparatus main body, comes into contact with the drive electrode disposed on the image forming cartridge side or with a second electrode which is electrically connected to the present drive electrode on the image forming cartridge. Therefore, the voltage of the detect electrode corresponds to the bias voltage that is supplied to the image forming cartridge.

Thus, the control unit controls the output of the power supply based on the voltage of the detect electrode, thereby being able to control the bias voltage. Also, when the voltage of the detect electrode is abnormal, the abnormal condition detect unit detects the abnormal condition of the image forming cartridge. In other words, when an abnormal condition such as disconnection occurs in the image forming cartridge itself, or when the image forming cartridge is not mounted in a normal condition but instead a poor contact occurs between the pair of drive electrodes, the voltage of the detect electrode deviates from a normal range. Thus, when the voltage of the detect electrode is abnormal, the abnormal condition detect unit can detect the abnormal condition of the image forming cartridge.

As described above, according to the first aspect of the invention, using a simple structure obtained by including electrodes in an image forming apparatus, the output of the power supply can be controlled by the control unit to thereby be able to maintain the bias voltage at a proper value. Further, the abnormal condition of the image forming cartridge itself and the abnormal mounting condition of the image forming cartridge can be detected by the abnormal condition detect unit. Therefore, according to the image forming apparatus of the first aspect of the invention, good image formation can be attained while limiting the manufacturing cost. Incidentally, the given electric potential may be any electric potential, provided that it is a known electric potential. For example, the given electric potential may be a so-called grounding electric potential or other reference electric potential.

According to a second aspect of the invention, the image forming apparatus further comprises a resistor interposed between the detect electrode ant the abnormal condition detect unit. Further, between the given electric potential and the resistor unit, there may also be interposed a voltage-dividing resistor or the like.

Although the voltage of the detect electrode may be controlled by way of a signal having an analog value, other structures may be employed. According to a third aspect of the invention, the image forming apparatus further comprises: a conversion unit which converts the voltage of the detect electrode to a digital value; and a common processing unit which constitutes the control unit and the abnormal condition detect unit, wherein the control unit controls the output of the power supply based on the voltage of the detect electrode converted to the digital value by the conversion unit, and wherein the abnormal condition detect unit detects the abnormal condition based on the voltage of the detect electrode converted to the digital value by the conversion unit. In this case, because the voltage of the detect electrode is converted to a digital value by the conversion unit, the control unit can be constructed by a software process which controls the output of the power supply based on the voltage of the detect electrode converted to the digital value, and the abnormal condition detect unit can be constructed by a software process which detects the abnormal condition based on the voltage of the detect electrode converted to the digital value. In this case, the control unit and abnormal condition detect unit can be structured by a common processing device such as a microcomputer. Therefore, in this case, the structure of the image forming apparatus can be further simplified and the manufacturing cost thereof can be further reduced.

According to a fourth aspect of the invention, the image forming apparatus further comprises a stop unit which stops the operation of the image forming apparatus main body when the abnormal condition detect unit detects the abnormal condition of the image forming cartridge. In this case, when the abnormal condition of the image forming cartridge is detected, the operation of the image forming apparatus is stopped and poor image formation can be prevented.

According to a fifth aspect of the invention, the image forming apparatus further comprises a notify unit which notifies of the abnormal condition of the image forming cartridge. In this case, when the abnormal condition of the image forming cartridge is detected, by notifying of the abnormal condition, the image forming apparatus can urge a user to take proper measures against the abnormal condition.

According to a sixth aspect of the invention, the image forming cartridge comprises the second electrode an the drive electrode, the second electrode being separate from the drive electrode, and the second electrode and the drive electrode of the image forming cartridge are electrically connected to each other through a resistor component. In this case, a voltage which is divided by the resistor component and the resistor unit is applied to the detect electrode. Here, a bias voltage to be supplied to the image forming cartridge can sometimes vary in the respective image forming cartridges depending on the kind of developer used and, in this case, the proper value of the voltage of the detect electrode varies accordingly in the respective image forming cartridges. However, even in such a case in using the structure of the fifth aspect of the invention, by setting the value of the resistor component that corresponds to the respective image forming cartridges, the bias voltage can be set properly without changing the structures of the control unit and abnormal condition detect unit.

The invention is not limited in the structure of the image forming cartridge, and according to a seventh aspect of the invention, the image forming cartridge comprises a developing unit which develops an electrostatic latent image formed on an image carrier of the image forming unit using a developer, and a bias voltage supplied through the pair of drive electrodes is applied to the developing unit.

According to an eighth aspect of the invention, there is provided an image forming cartridge removably installable onto an image forming apparatus, the image forming cartridge comprising: a developing unit which develops an electrostatic latent image formed on an image carrier using a developer; and a drive electrode which is contacted with a drive electrode of the main body of the image forming apparatus and to which a bias voltage to be applied to the developing unit is supplied when the image forming cartridge is mounted to the image forming apparatus main body, wherein at least one of the drive electrode of the image forming cartridge and a second electrode on the image forming cartridge electrically connected to the drive electrode of the image forming cartridge is contacted with a second electrode of the image forming apparatus main body when the image forming cartridge is mounted on the image forming apparatus main body.

According to a ninth aspect of the invention, the second electrode of the image forming cartridge is contactable with the second electrode of the image forming apparatus main body, and the second electrode of the image forming cartridge and the drive electrode of the image forming cartridge are electrically connected to each other through a resistor component. In this case, similar to that as described above, even when a proper bias voltage varies in the respective image forming cartridges, by setting the value of the resistor component according to the respective image forming cartridges, a proper bias voltage can be set without changing the structure of the image forming apparatus main body.

<Illustrative Aspects>

Description will now be given of aspects of an image forming apparatus and an image forming cartridge with reference to the accompanying drawings. FIG. 1 is a perspective view showing a laser printer 1 used as an image forming apparatus. As shown in FIG. 1, on the lower portion of a cover 2 for covering the main body of the laser printer 1 from the outer periphery thereof, there is mounted a sheet feed cassette 3. On the surface of the cover 2 (that is, the surface which is disposed on this side when the laser printer 1 is installed), there is provided a cover portion 4 of the cover 2.

Figure 2:
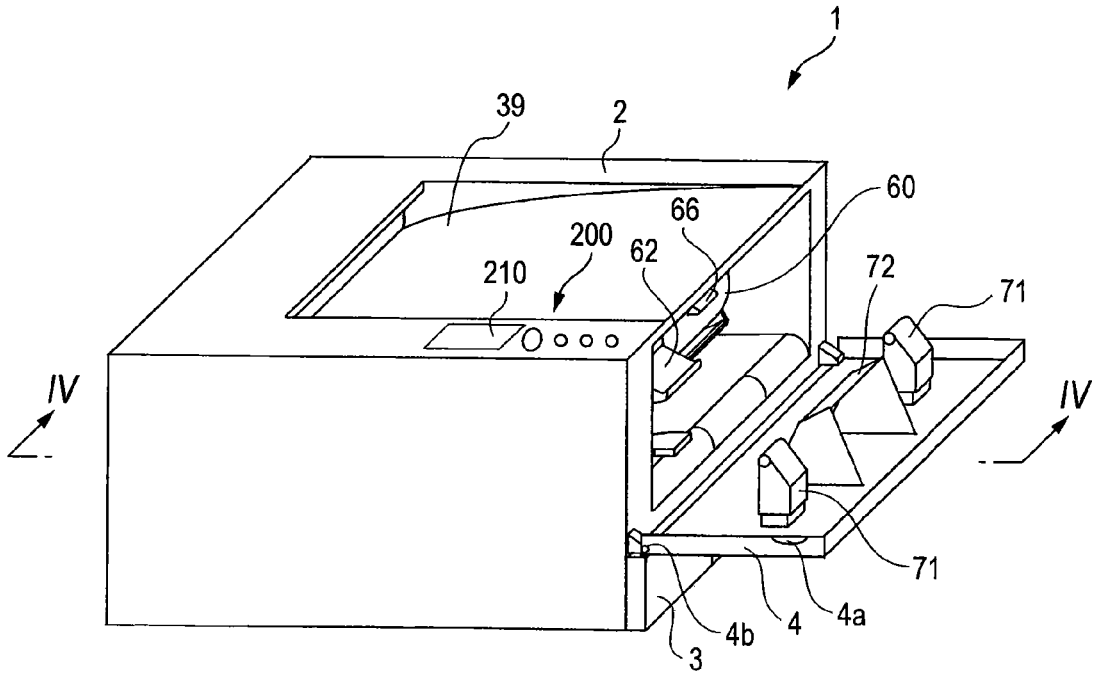
FIG. 2 is a perspective view of the laser printer, showing its operation for opening the cover portion thereof.
Figure 3:
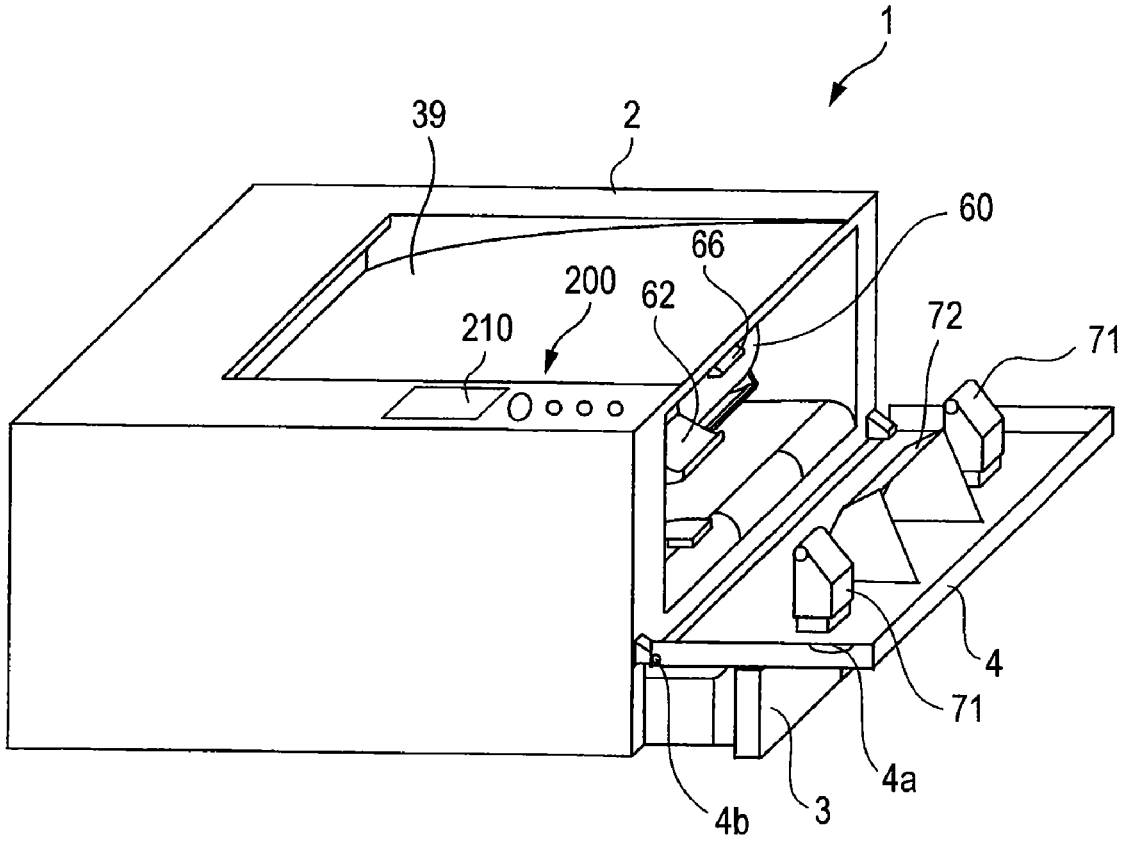
FIG. 3 is a perspective view of the laser printer, showing its operation for drawing out a sheet feed cassette therefrom.

The cover portion 4 includes two finger portions 4*a* respectively formed in the upper portions of the right and left end portions thereof and, by pulling the finger portions 4*a*, as shown in FIG. 2, the cover portion 4 can be opened by rotating about a hinge 4*b* provided in the lower end portion of the cover portion 4. Further, as shown in FIG. 3, the sheet feed cassette 3 is disposed such that it can be drawn outwards, and by drawing out the sheet feed cassette 3 in this manner, it can be mounted onto and removed from the laser printer 1. In addition, as shown in FIGS. 1 to 3, on the top surface of the cover 2, there is disposed an operation panel 200 which includes a display portion 210.

Figure 4:
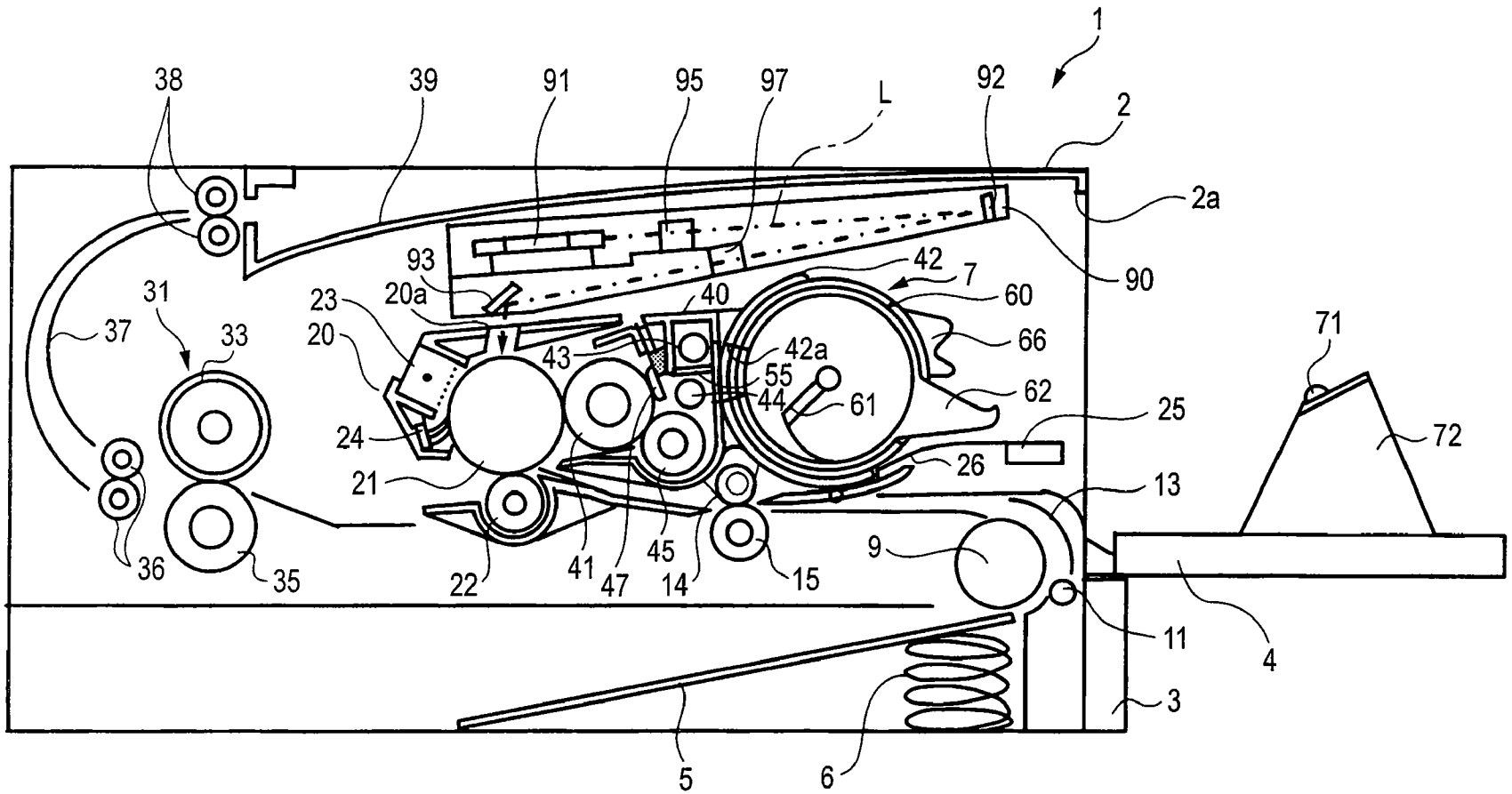
FIG. 4 is a longitudinal section view of the internal structure of the laser printer.

Next, FIG. 4 is a longitudinal section view of the laser printer 1, showing the internal structure thereof. In addition, FIG. 4 corresponds to a sectional view taken along the line IV-IV shown in FIG. 2. As shown in FIG. 4, in the interior of the sheet feed cassette 3, there is disposed a support plate 5 which is energized upward by a spring 6 and, on the front surface side of the cassette 3 situated further above the support plate 5, there is disposed a sheet feed roller 9. The sheet feed roller 9 is used to separately supply sheets (not shown) in a sheet-by-sheet manner in the direction of an image forming portion 7. The sheets function as mediums to be recorded which are held in a piled-up manner on the support plate 5. Also, in a sheet delivery path extending from the sheet feed roller 9 to the image forming portion 7, there are disposed a delivery roller 11 which works with the sheet feed roller 9 to deliver the sheets, a guide 13 for redirecting in a 180° change of direction the sheet delivered by the delivery roller 11 along the outer periphery of the sheet feed roller 9, and a pair of resist rollers 14, 15 which, when they are stopped accordingly, can secure the leading end of the sheet and correct the oblique movement of the sheet.

The image forming portion 7 includes a photosensitive drum 21 disposed within a sensitive cartridge 20 and functioning as an image carrier, and a transfer roller 22 disposed such that it is opposed to the photosensitive drum 21. When a sheet is passed through between the photosensitive drum 21 and transfer roller 22, as will be discussed later, an image is formed on the sheet by toner functioning as a developer. The sheet is then supplied to a fixing portion 31. In the fixing portion 31, the toner image formed on the sheet is held by and between a heating roller 33 and a pressing roller 35 and is thermally fixed. A pair of delivery rollers 36 further delivers the sheet with the image fixed.

The sheet, which has been delivered by the delivery rollers 36 is then guided by a guide 37 to the upper portion of the cover 2 and is next discharged by a pair of discharge rollers 38 into a sheet discharge tray 39 provided on the top surface of the cover 2. Also, between the sheet discharge tray 39 and sensitive cartridge 20, there is interposed a scanner unit 90 which is used to expose the photosensitive drum 21 to a laser beam L.

Next, description will be given in more detail of the structures of the image forming portion 7 and scanner unit 90. The sensitive cartridge 20 includes the photosensitive drum 21 having a sensitive layer on the surface thereof such that the photosensitive drum 21 can be rotated, and further includes a scorotron charger 23 serving as a charging unit which charges the surface of the photosensitive drum 21 uniformly. An electrostatic latent image is formed on the surface of the photosensitive drum 21 charged by the scorotron charger 23 by using a laser beam L incident on the drum surface and projected from the scanner unit 90 through an exposure opening portion 20*a*. Then, a developing roller 41, serving as a developing unit disposed on a developing cartridge 40, supplies a toner to the surface of the photosensitive drum 21, whereby the electrostatic latent image is developed. The toner attached to the photosensitive drum 21 in this manner is transferred to a sheet passing through between the photosensitive drum 21 and the transfer roller 22, whereby an image is formed on the sheet. Further, a sheet powder collect brush 24, to which a bias of a positive polarity has been applied, is in contact with the surface of the photosensitive drum 21 to thereby remove the sheet powder (which is negatively charged) attached to the photosensitive drum 21 from the sheet.

The developing roller 41, as shown in FIG. 4, is rotatably supported on the developing cartridge 40, and when the developing roller 41 is contacted with the photosensitive drum 21, it can be driven and rotated by a mechanism (which will be discussed later). The developing cartridge 40 includes a support portion 42 for supporting a toner cartridge 60 to be removable. In the support portion 42, there is opened up an opening portion 42*a* to which the toner can be supplied from the toner cartridge 60 (see FIG. 7). The developing cartridge 40 further includes on both sides in the axial direction of the developing cartridge 40 an upper auger 43 and a lower auger 44 respectively used to circulate the toner, which has been supplied from the opening portion 42*a* opened up in the axial-direction central portion of the support portion 42; a supply roller 45 for supplying the toner delivered by the lower auger 44 toward the developing roller 41; and a developing blade 47 for frictionally charging the toner attached to the surface of the developing roller 41 by the supply roller 45 to thereby form a thin toner layer. In addition, between the upper and lower augers 43 and 44, there is interposed a separation wall 55 which is used to smooth the circulation of the toner. Also, within the toner cartridge 60, there is rotatably disposed an agitator 61 which is used to stir up toner and supply the toner toward the developing cartridge 40.

Next, the structure of the scanner unit 90 will be described. The scanner unit 90 includes a polygon mirror 91 for deflecting and scanning a laser beam L generated by a laser generating part (not shown), and mirrors 92, 93 for turning back the laser beam L deflected by the polygon mirror 91 toward the photosensitive drum 21. Also, in the optical path of the laser beam L extending from the polygon mirror 91 to the mirror 92, there is fixed an fθ lens 95; and in the optical path of the laser beam L from the mirror 92 to the mirror 93, there is fixed a cylindrical lens 97.

According to the structure, by radiating the laser beam L at a proper timing while rotating the polygon mirror 91 and photosensitive drum 21; an electrostatic latent image can be formed on the surface of the photosensitive drum 21. Then, as described above, by developing the electrostatic latent image using the toner through the developing the roller 41 and transferring the thus developed latent image to the sheet, an image can be formed according to an electrophotographic method.

Figure 5:
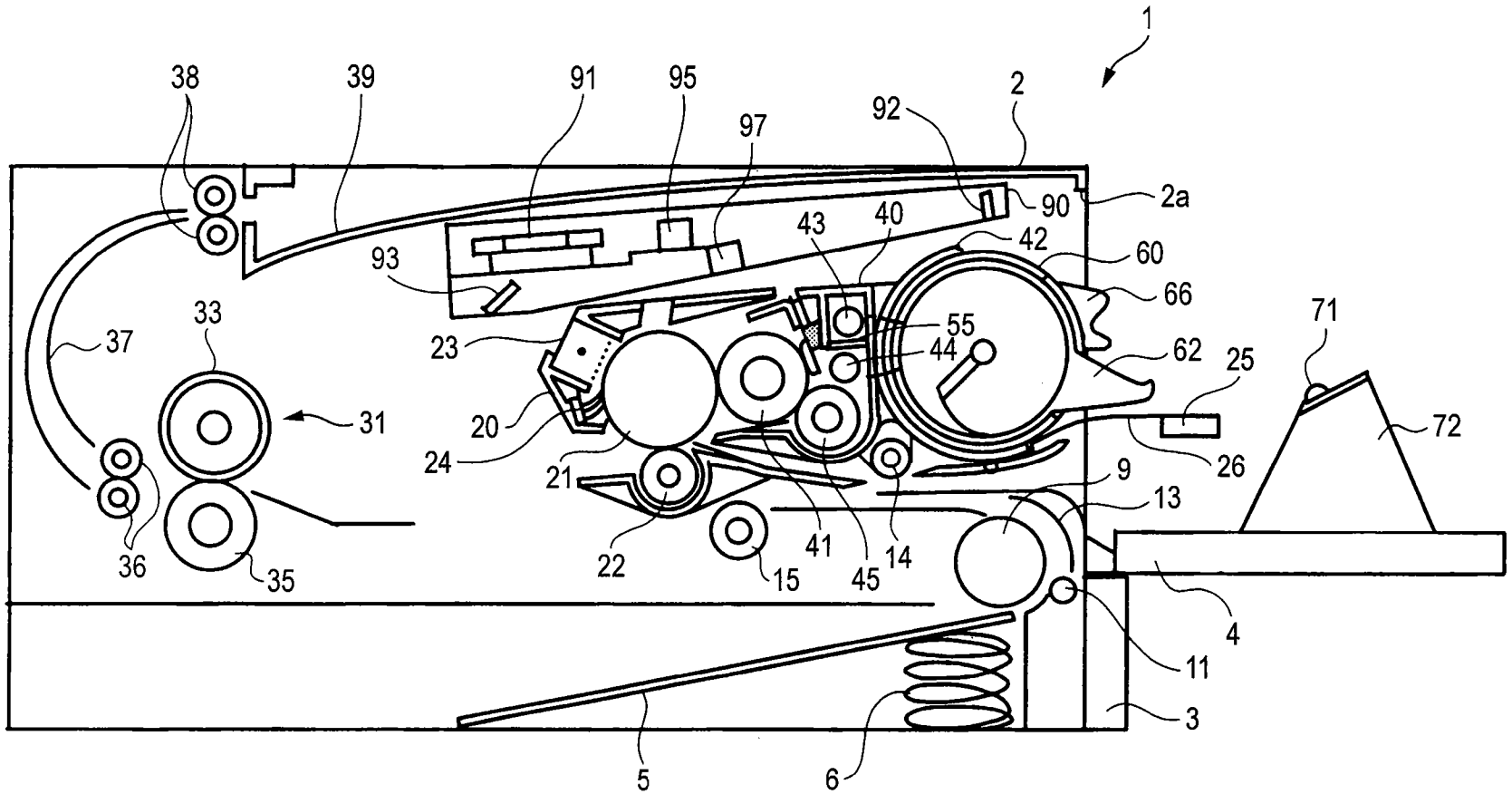
FIG. 5 is a longitudinal section view of the laser printer, showing its operation for drawing out the respective cartridges integrally therefrom.

Next, as shown in FIG. 5, when the cover portion 4 is opened and the handle 25 of the sensitive cartridge 20 is also pulled outward, the sensitive cartridge 20 can be drawn out of the main body of the laser printer 1 from a mounting and removing opening 2*a* integrally with the developing cartridge 40 and toner cartridge 60. Incidentally, the mounting and removing opening 2*a* is an opening of the cover 2 within which the cover portion 4 integrally fits when closed.

Figure 6:
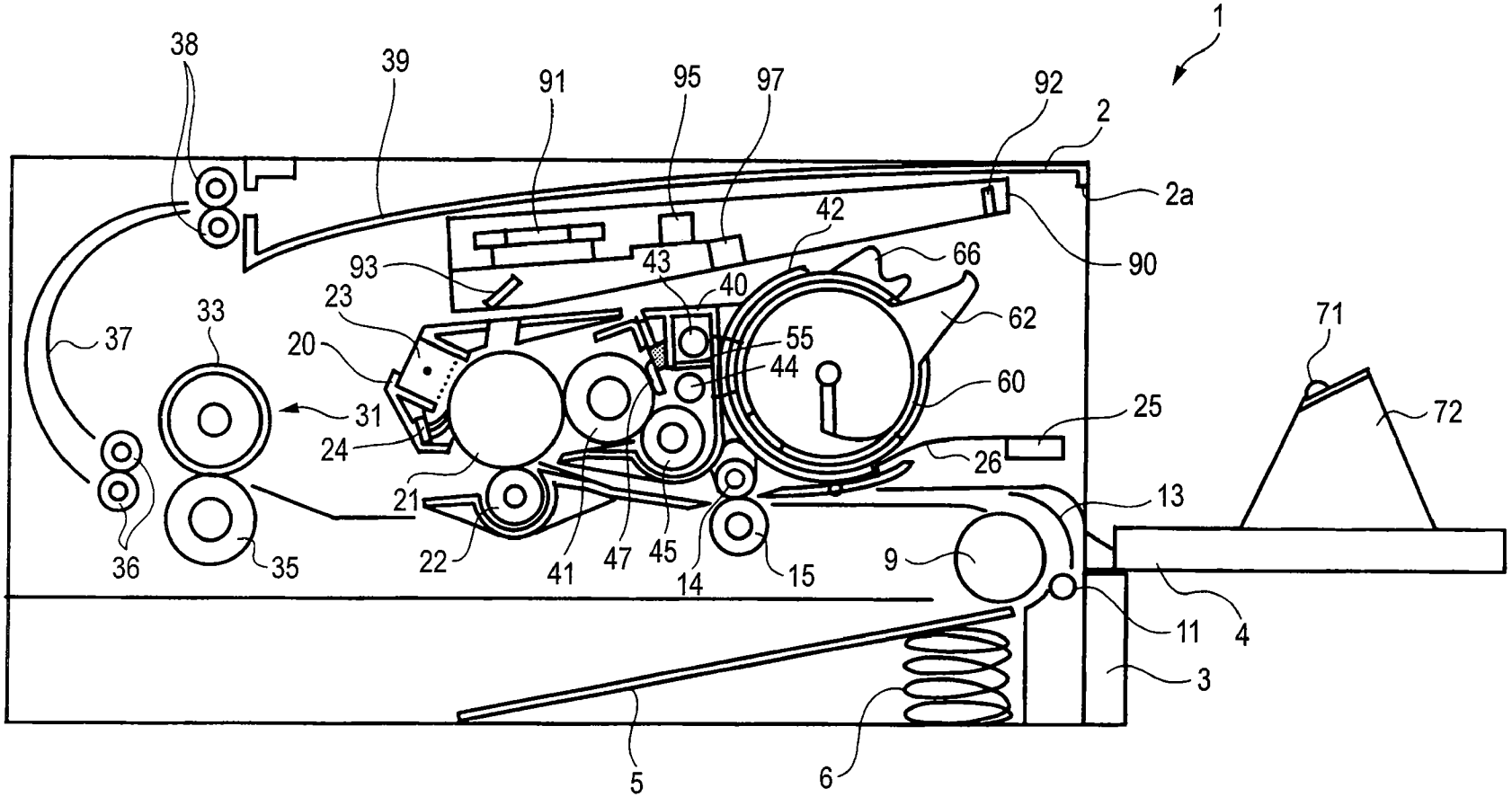
FIG. 6 is a longitudinal section view of the laser printer, showing its operation for separating a toner cartridge and a developing cartridge from each other.
Figure 7:
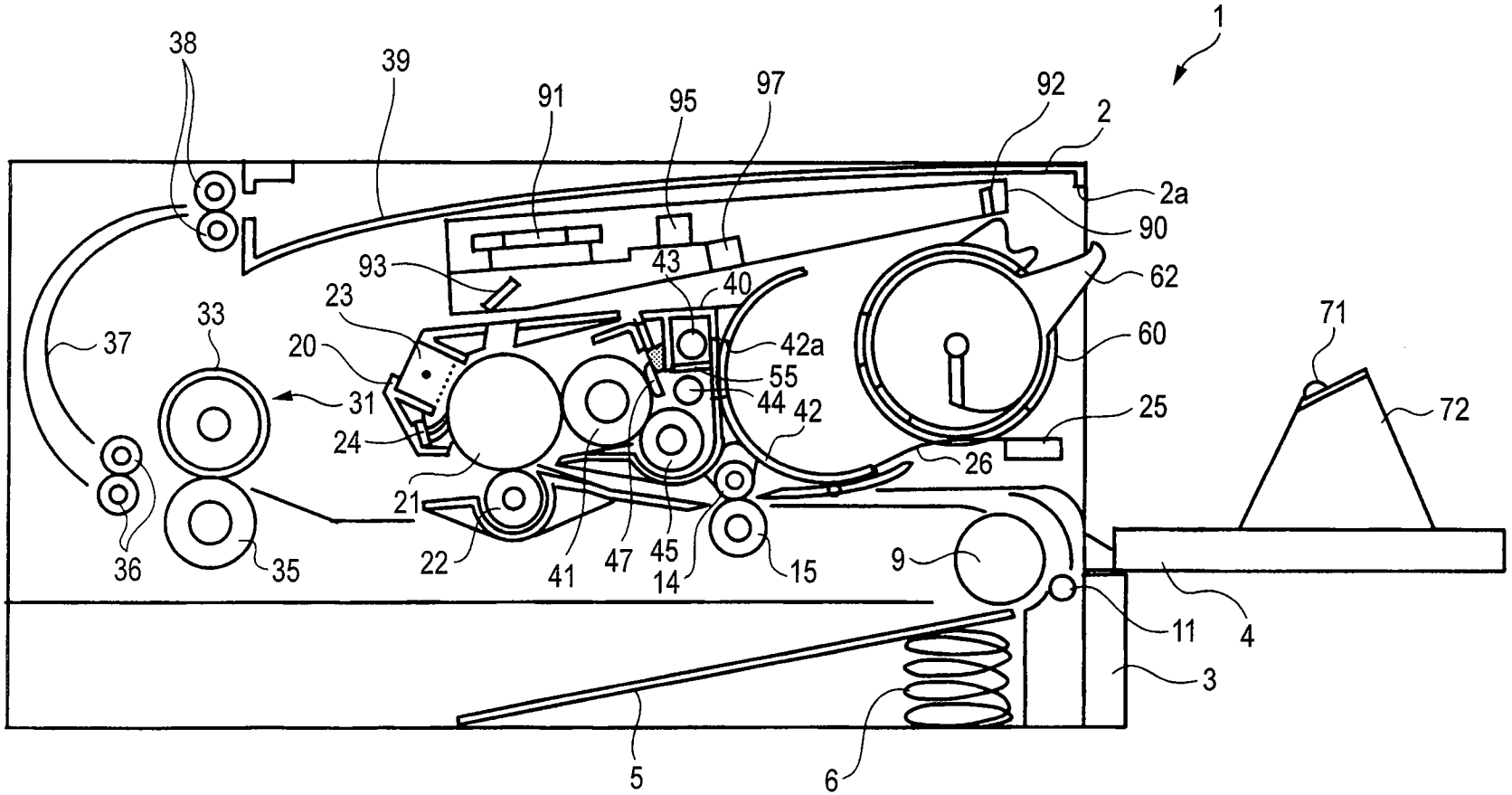
FIG. 7 is a longitudinal section view of the laser printer, showing its operation for drawing out only the toner cartridge therefrom.

Also, as shown in FIG. 6, when the handle 62 of the toner cartridge 60 is turned upward, the engaging portion thereof (not shown) between the toner cartridge 60 and developing cartridge 40 is removed from its engaged state, whereby the toner cartridge 60 is separated from the developing cartridge 40; and when the handle 62 is further pulled outward, as shown in FIG. 7, the toner cartridge 60 can be drawn out of the main body of the laser printer 1 from the mounting and removing opening 2*a*.

Figure 8:
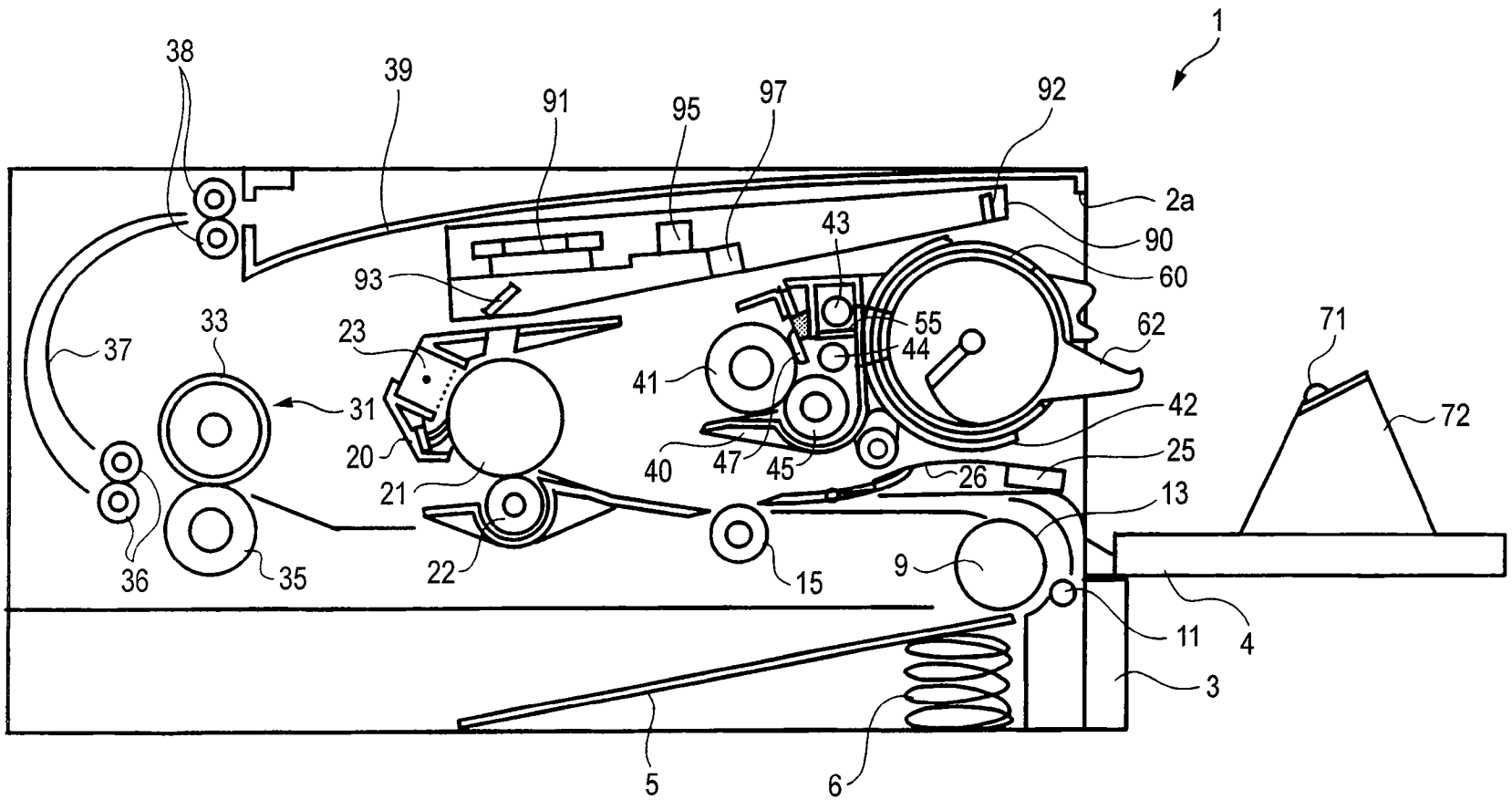
FIG. 8 is a longitudinal section view of the laser printer, showing its operation for drawing out a developing cartridge and a toner cartridge integrally therefrom.

Further, as shown in FIG. 8, when the handle 25 of the sensitive cartridge 20 is pressed down, a plate spring 26 to which the developing cartridge 40 is engagingly fixed, is also pressed down. When the handle 62 of the toner cartridge 60 is not turned upward but is instead pulled outward, the toner cartridge 60 and developing cartridge 40 are not separated from each other but they can be drawn out of the main body of the laser printer 1 from the mounting and removing opening 2*a* as an integral body.

Figure 9:
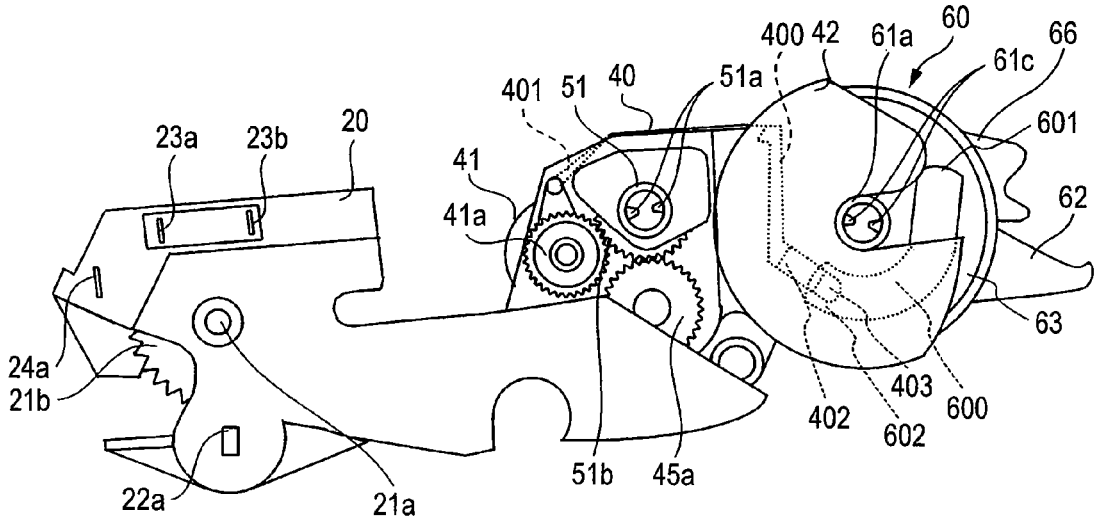
FIG. 9 is a left side view of the laser printer, showing a state in which the toner cartridge is mounted on the developing cartridge.

Next, description will be given below of the structures of the respective portions that compose the above-structured image forming portion 7. As shown in FIG. 9, on the facing-side surface (which is hereinafter referred to as the left side) of the sensitive cartridge 20, there are disposed an electrode 22*a* to which a bias voltage to be supplied to the transfer roller 22 is applied, an electrode 23*a* to which a bias voltage to be supplied to the discharge wire of the scorotron charger 23 is applied, an electrode 23*b* for detecting a voltage applied to the grid of the scorotron charger 23, and an electrode 24*a* to which a bias voltage to be supplied to the sheet powder collect brush 24 is applied. A metal-made rotary shaft 21*a* of the photosensitive drum 21 projects out on the right and left side of the sensitive cartridge 20.

Figure 10:
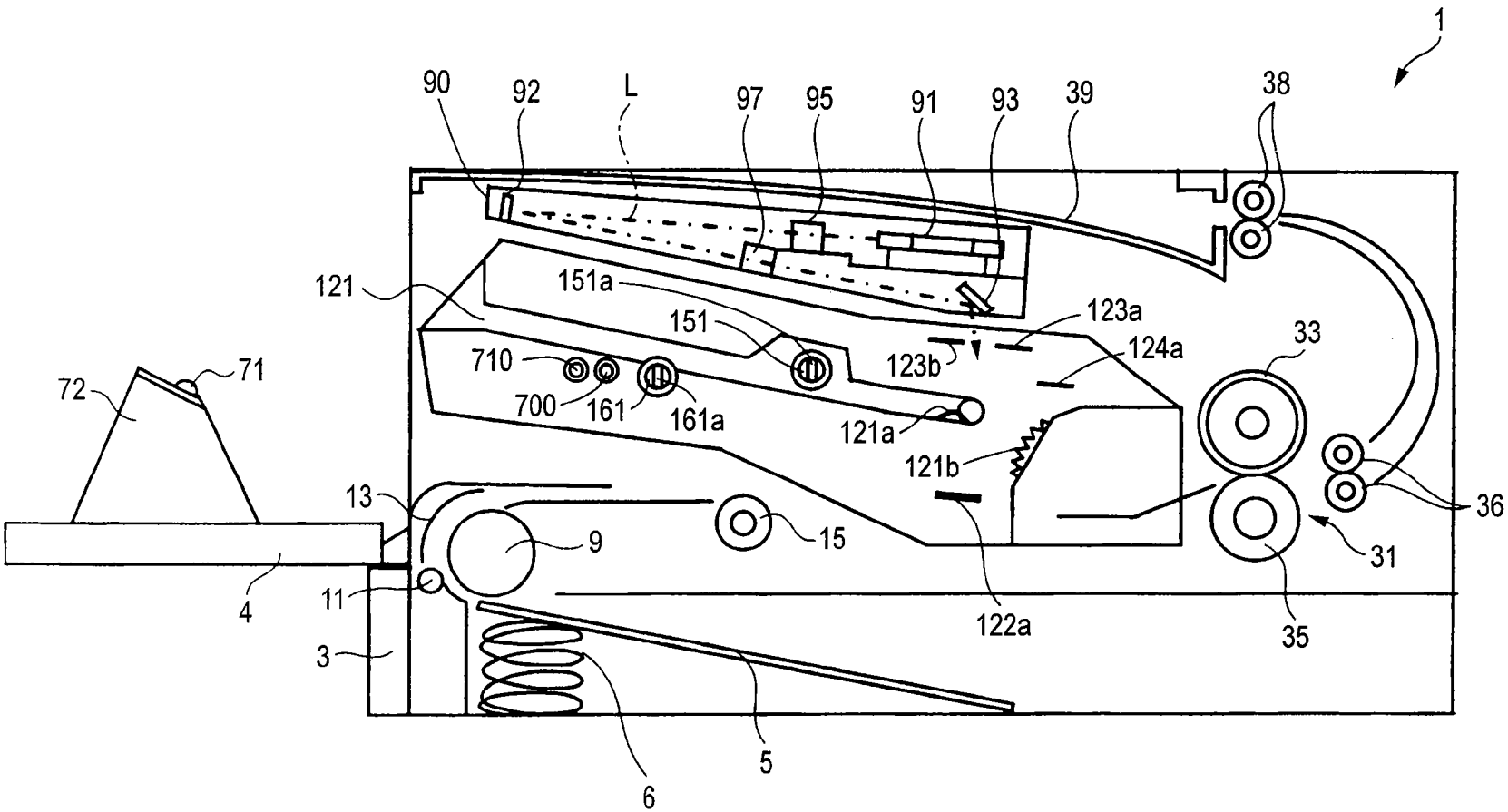
FIG. 10 is an explanatory view of the structure of the left inner wall surface of the main body of the laser printer.

On the other hand, in the left inner wall surface of the main body of the laser printer 1, as shown in FIG. 10, there is formed a guide groove 121 which is used to guide the rotary shaft 21*a*. Also, on the left inner wall surface, there are disposed electrodes 122*a*, 123*a*, 123*b* and 124*a* in such a manner that they are opposed to electrodes 22*a*, 23*a*, 23*b* and 24*a* respectively. Incidentally, the electrodes 22*a*, 23*a*, 23*b* and 24*a* are formed to be longer in the vertical direction, whereas the electrodes 122*a*, 123*a*, 123*b* and 124*a* are formed to be longer in the horizontal direction. Therefore, even if the electrodes 22*a* to 24*a* and 122*a* 124*a* are somewhat shifted in position from each other, when the sensitive cartridge 20 is mounted, the electrodes 22*a* to 124*a* are able to come into good contact with each other. According to such contact, a given bias voltage can be applied to the respective portions from the main body of the laser printer 1. Also, on the leading end of the guide groove 121 as well, there is disposed an electrode 121*a*, and when the electrode 121*a* is contacted with the rotary shaft 21*a*, the photosensitive drum 21 can be grounded.

Also, as shown in FIG. 9, from the rear side (the mounting direction side) of the sensitive cartridge 20, there is exposed a gear 21*b* which can be rotated integrally with the photosensitive drum 21. On the main body side of the laser printer 1, as shown in FIG. 10, there is provided a gear 121*b* which can be engaged with the gear 21*b*. When the sensitive cartridge 20 is mounted, these gears 21*b* and 121*b* are engaged with each other, whereby a drive force can be transmitted from the laser printer main body side to the photosensitive drum 21. Incidentally, in FIG. 9, for convenience's sake, the illustration of the plate spring 26 and the like is omitted.

Next, on the left side surface of the developing cartridge 40, there is disposed a drive shaft 51 to which a drive force can be transmitted from a drive shaft 151 provided on the laser printer main body side. The drive shaft 151 includes a flat-plate-shaped projecting portion 151*a*, while the drive shaft 51 is structured in a tubular recessed shape with which the drive shaft 151 can be fitted and includes a projection 51*a* which is engageable with the flat-plate-shaped projecting portion 151*a*. The two drive shafts 51 and 151 cooperate together in constituting a so-called drive coupling.

As shown in FIG. 9, the drive shaft 51 includes a gear 51*b* which can be rotated integrally with the drive shaft 51. The gear 51*b* is in meshing engagement with a gear 41*a* which is rotatable integrally with a developing roller 41 and a gear 45*a* which is rotatable integrally with a supply roller 45. Therefore, when a drive force is transmitted from the drive shaft 151 to the drive shaft 51, the developing roller 41 and supply roller 45 can be rotated by the drive force.

Also, from the side surface of the toner cartridge 60, there is projected the rotary shaft 61*a* of the agitator 61. The rotary shaft 61*a*, as shown in FIGS. 9 and 10, cooperates together with a drive shaft 161 provided on the laser printer main body side in constituting a so-called drive coupling. That is, the drive shaft 161 includes a flat-plate-shaped projecting portion 161*a* on the end face thereof, whereas the rotary shaft 61*a* is structured in a tubular recessed shape with which the drive shaft 161 can be fitted and also includes two projections 61*c* engageable with the flat-plate-shaped projecting portion 161*a*. Therefore, when a drive force is transmitted from the drive shaft 161 to the rotary shaft 61*a*, the agitator 61 can be rotated by the drive force.

Next, description will be given below of a structure for applying a bias voltage to the developing roller 41. As shown in FIG. 9, the developing cartridge 40 includes an electrode member 400, and the toner cartridge 60 includes an electrode member 600. One end 401 of the electrode member 400 is connected to the shaft of the developing roller 41. The other end neighboring portion 402 of the electrode member 400 rises up from the left side inner wall surface of a support portion 42 toward an inward direction, and the other end 403 of the electrode member 400 is elastically supported in a state where it is spaced from such inner wall surface.

The electrode member 600 is disposed on the left side surface of a tubular portion 63 rotatable in linking with the operation of the handle 62 of the toner cartridge 60 and extends in an arc shape around the rotary shaft 61*a*. According to this structure, when the toner cartridge 60 is mounted onto the developing cartridge 40 and the handle 62 is turned downward, as shown in FIG. 9, the other end 602 of the electrode member 600 is wedged between the other end 403 of the electrode member 400 and the left side surface of the toner cartridge 60, whereby the two electrode members 600 and 400 are electrically connected together. At this time, one end 601 of the electrode member 600 is exposed to the outside of the support portion 42, whereas the remaining portions of the electrode member 600 and the electrode member 400 are not exposed to the outside.

Figure 11:
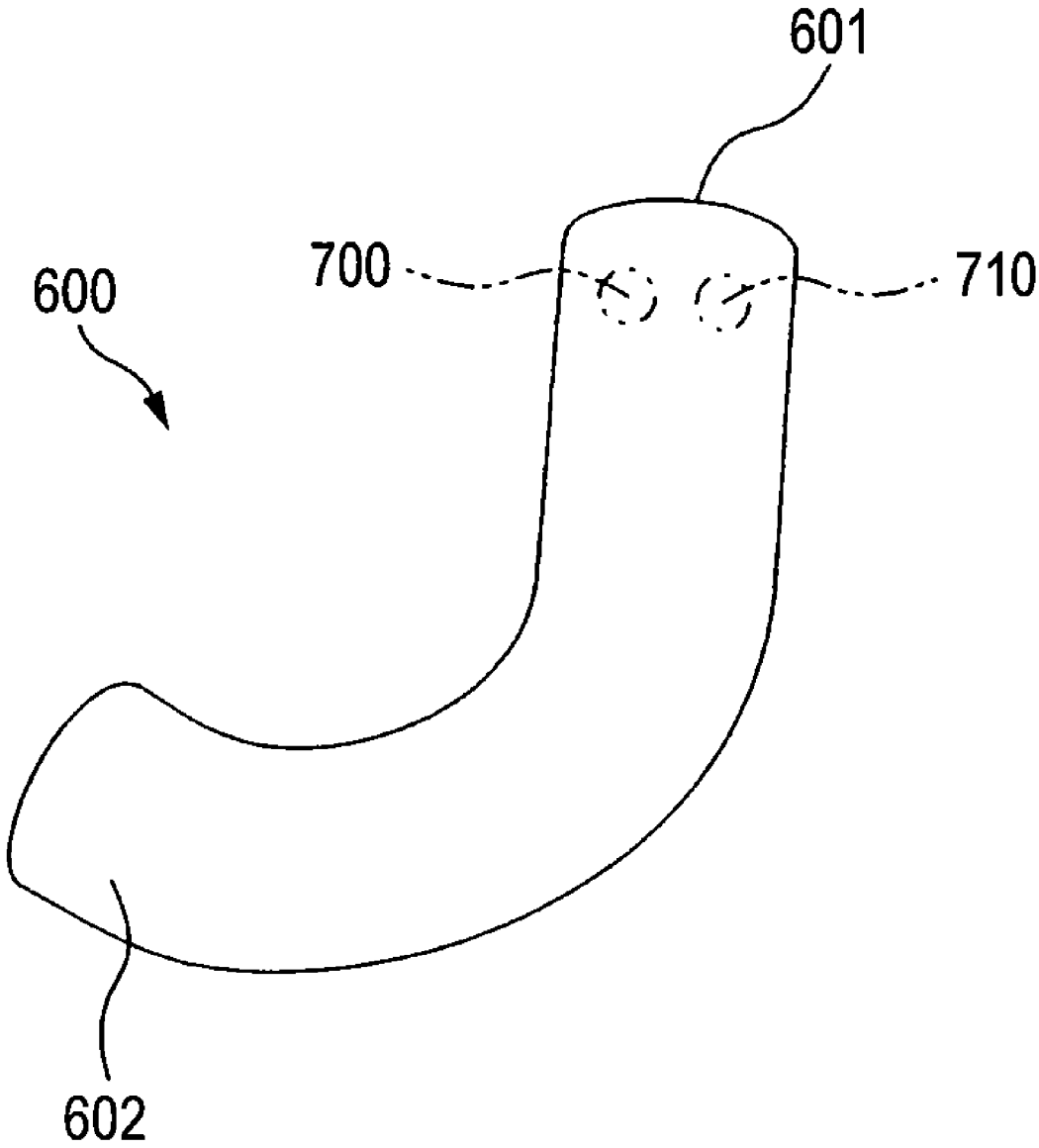
FIG. 11 is an explanatory typical view of the structure of an electrode member used in the toner cartridge.

On the left side inner wall surface of the main body of the laser printer 1, as shown in FIG. 10, at positions opposed to one end 601 of the electrode member 600, there are disposed a drive electrode 700 and a detect electrode 710 side by side. Accordingly, when the developing cartridge 40 and toner cartridge 60 are mounted on the main body of the laser printer 1, as typically shown in FIG. 11, the drive electrode 700 and detect electrode 710 can be contacted with the electrode member 600. Therefore, as will be discussed later, a bias voltage can be applied from the drive electrode 700 to the developing roller 41 through the electrode members 600 and 400 and the state of the developing roller 41 can be detected on the laser printer main body side through the detect electrode 710. Also, when the handle 62 is turned upward, the other end 602 of the electrode member 600 is separated from the electrode member 400 and, as shown in the above-described FIGS. 6 and 7, the toner cartridge 60 can be removed from the developing cartridge 40.

The drive electrode 700 and detect electrode 710 on the laser printer main body side are disposed such that they can be projected and retreated together with the drive shafts 151 and 161. The drive electrode 700, detect electrode 710, drive shaft 151 and drive shaft 161 are respectively connected to a link mechanism (not shown) in such a manner that they can be projected and retreated in linking with the closing and opening operations of the cover portion 4. Specifically, when the cover portion 4 is opened, they are retreated, so that not only the drive electrode 700 and detect electrode 710 are separated from the electrode member 600 but also the engagement between the drive shafts 151, 161 and the drive shaft 51 and rotary shaft 61*a* is removed. Because of this, the sensitive cartridge 20, developing cartridge 40 and toner cartridge 60 can be mounted and removed. On the other hand, when the cover portion 4 is closed, the drive electrode 700, detect electrode 710, drive shaft 151 and drive shaft 161 are projected, so that not only the electrode member 600 is contacted with the drive electrode 700 and detect electrode 710, but the drive shaft 151 and the drive shaft 161 are also engaged with the drive shaft 51 and rotary shaft 61*a* respectively. Accordingly, not only can the bias voltage be applied to the developing roller 41, but the respective portions can also be driven.

Also, on the surface of the tubular portion 63 located slightly upwards from the two sides of the handle 62, there are formed a pair of right and left spring receiving portions 66 the peripheral-direction central portions of which are respectively depressed. As shown in FIG. 2, on the inner surface of the cover portion 4, there are provided a pair of pressing members 71 which are energized in their projecting directions by springs (not shown). The spring receiving portions 66 receive pressing forces applied from the pressing members 71 when the cover portion 4 is closed. As a result of the pressing forces, the respective cartridges 20, 40 and 60 can be positively fixed to the inside of the image forming apparatus. Also, there is an interference member 72 between the two pressing members 71, 71. When the handle 62 is turned downward, the developing cartridge 40 and toner cartridge 60 are separated from each other, and the handle 62 and interference member 72 interfere with each other to thereby make it impossible to close the cover portion 4.

Next, description will be given below of an electric system provided on the laser printer main body side in relation to the drive electrode 700 and detect electrode 710. In the following description, a connected body of the developing cartridge 40 and toner cartridge 60 is sometimes referred to as a developing unit 80.

Figure 12:
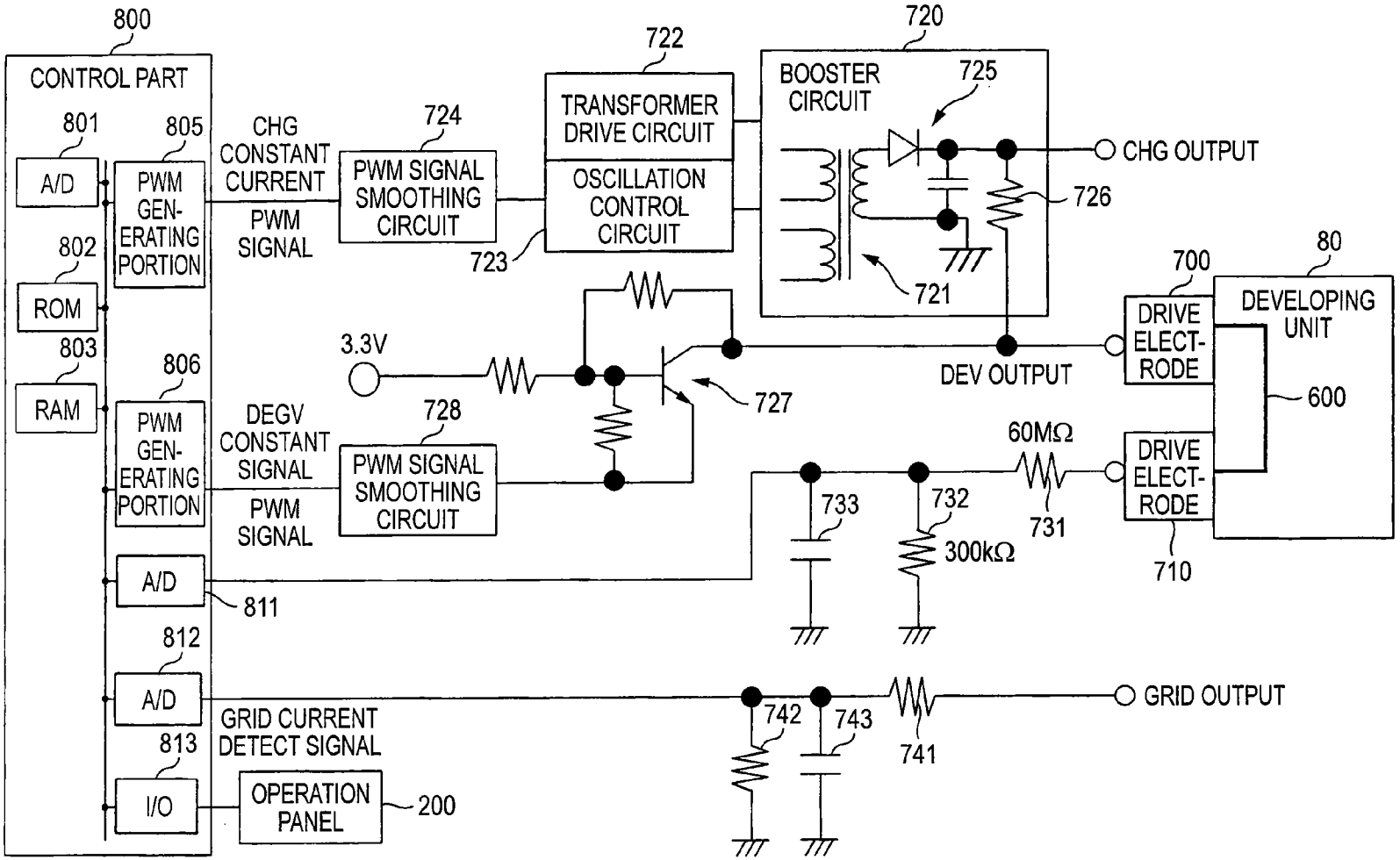
FIG. 12 is a schematic block diagram of the structure of an electric system used in the laser printer.

As shown in FIG. 12, on the main body side of the laser printer 1, there is provided a booster circuit 720 including a transformer 721. A current can be supplied to the primary side of the transformer 721 through a transformer drive circuit 722, and the oscillation of the primary side of the transformer 721 can be controlled by an oscillation control circuit 723. The oscillation control circuit 723 is used to control the "on" period of the primary side of the transformer 721 according to a pulse width modulation (PWM) signal smoothed (converted to an analog signal) by a PWM signal smoothing circuit 724. According to the control of the oscillation control circuit 723, the output voltage of the secondary side of the transformer 721 can be varied.

On the secondary side of the transformer 721, there is provided a well-known smoothing and rectifying circuit 725 which includes a diode and a capacitor. The output of the smoothing and rectifying circuit 725 is output not only to an electrode 123*a* (see FIG. 10) as a CHQ output to be applied to the wire of the scorotron charger 23 but also to the drive electrode 700 through a resistor 726 as a DEV output to be applied to the developing roller 41. Also, the drive electrode 700 is connected to a PWM signal smoothing circuit 728 through a drive circuit 727 which includes a transistor. The PWM signal is smoothed (converted to an analog signal) by the PWM signal smoothing circuit 728, and the drive circuit 727 adjusts the DEV output corresponding to the smoothed PWM signal.

The detect electrode 710 is grounded through two resistors 731 and 732, while the terminal voltage of the detect electrode 710 between the resistors 731 and 732 is input to a control part 800. Incidentally, in this aspect as an example, the resistor 731 is set to 60 MΩ and the resistor 732 is set to 30 kΩ, whereby an electric potential obtained by multiplying the electric potential of the detect electrode 710 by about 0.005 is input to the control part 800. Also, a capacitor 733 is connected to the resistor 732 in parallel, thereby smoothing the variations of the above electric potential. The output of a grid (GRID output), which generates a voltage due to the discharge of the wire of the scorotron charger 23, is similarly grounded through two resistors 741 and 742, while the electric potential of the GRID output divided by the resistors 741 and 742 is input to the control part 800. Also, a capacitor 743 is connected to the resistor 742 in parallel, thereby smoothing the variations of the above electric potential.

The control part 800 is structured as an application specific integrated circuit (ASIC) which includes a CPU 801, a ROM 802 and a RAM 803. The control part 800 comprises not only PWM generating portions 805 and 806 which respectively output the PWM signals to the PWM signal smoothing circuits 724 and 728, but also A/D converters (A/D) 811 and 812 respectively for converting the divided electric potentials into digital signals. Also, the control part 800 further includes an I/O port (I/O) 813 which is connected to the operation panel 200 (see FIGS. 1 and 2).

Figure 13:
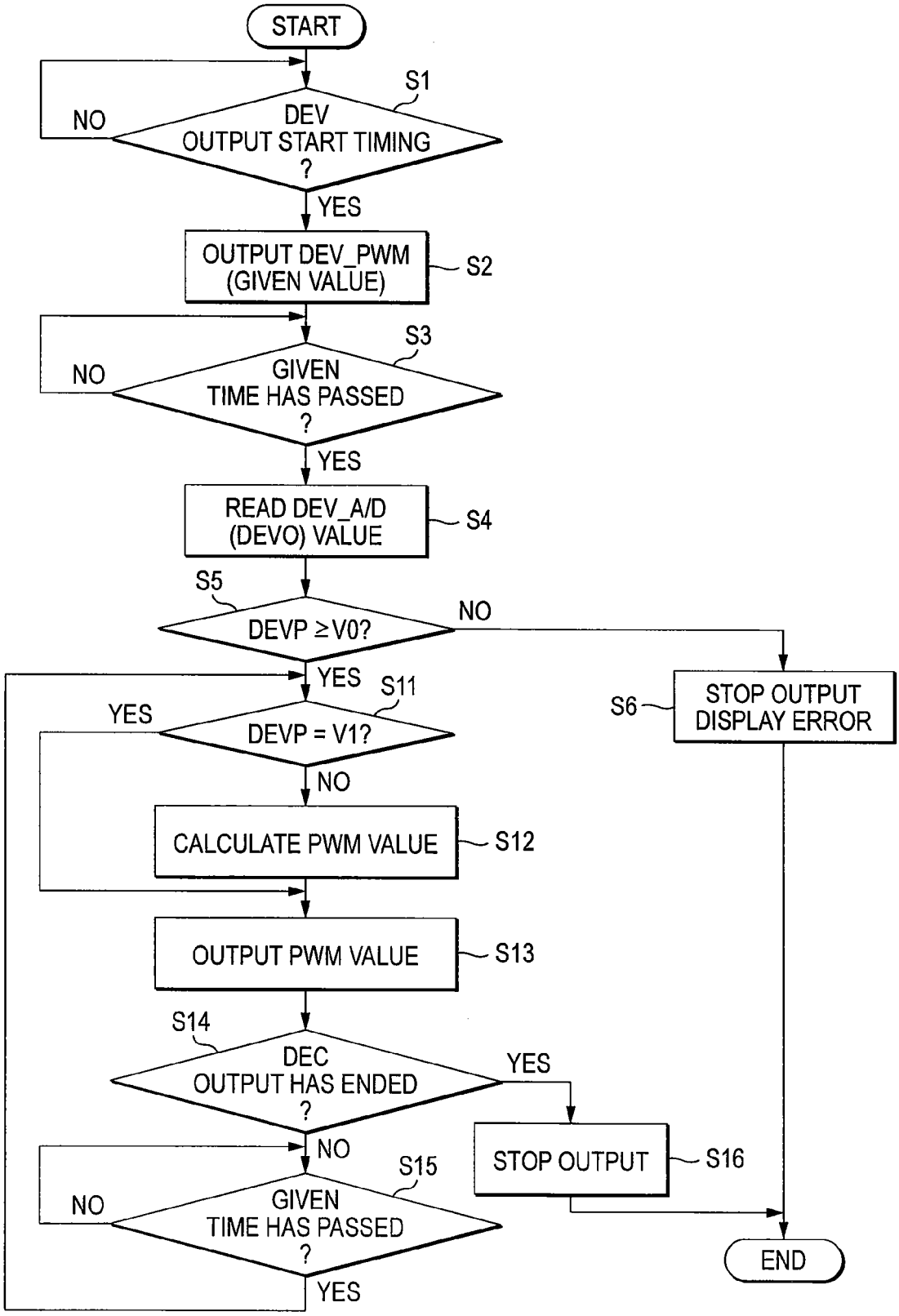
FIG. 13 is a flow chart of the control to be carried out in the control part of the electric system.

Next, with regard to the thus structured control part 800, description will be given below of processes executed by the CPU 801 according to a program stored in the ROM 802. FIG. 13 is a flow chart which represents the processes to be executed in the control part 800.

As shown in FIG. 13, when the processing is started, firstly, in S1 (S expresses a step, which will apply similarly in the following description as well), image formation is instructed by another routine (not shown) and thus it is checked whether or not a timing for starting the output of the bias voltage (DEV output) has been output to the developing roller 41. In the aspect, as can be understood from the structure of the booster circuit 720, when the CHG output is not supplied, it is impossible to execute the DEV output. Therefore, from the start of the image formation, the CHG is output continuously. Also, this CHG output is maintained at a desired constant value by the PWM generating portion 805 generating a PWM signal calculated by a routine according to an electric potential which is input to the A/D converter 812.

In S1, when it is determined that the timing of the DEV output has not started (S1: N), the processing waits and S1 is repeated. When it is determined that the timing of the DEV output has started (S1: Y), a PWM value of a given value is generated from the PWM generating portion 806 in S2. Next, in S3, it is checked whether or not a given time (the time necessary for the electric potential of the detect electrode 710 to be stabilized) has passed from the start of the DEV output. The processing waits and S3 is repeated until the given time has passed (S3: N). When the given time has passed (S3: Y), the electric potential (which is hereinafter referred to as DEVO) converted to a digital value by the A/D converter 811 is read in S4. Then, in S5, it is checked whether or not the DEVO is greater than or equal to a given value V0.

This given value V0 is set such that, when poor contact occurs between the drive electrode 700 or detect electrode 710 and electrode member 600, or poor contact or disconnection occurs in the electrode members 400 and 600 because of the developing unit 80 not being properly mounted or for some other reasons, the DEVO drops below the given value V0. Therefore, when it is judged in S5 that DEVO<V0 (S5: N), in S6, the DEV output is stopped and an error message is displayed on the display portion 210 of the operation panel 200, thereby ending processing.

On the other hand, when DEVO≧V0 (S5: Y), in S11, it is checked whether or not the DEVO is equal to the target value V1 (a bias voltage to be supplied to the developing roller 41) of a developing bias. When DEVO=V1 (S1: Y), the processing is advanced to S13. When DEVO≠V1 (S11: N), in S12, a PWM value for adjustment to DEVO=V1 is calculated, and then the processing is advanced to S13. In S13, the calculated PWM value is output from the PWM generating portion 806, and in S14, it is checked whether or not the DEV output has ended timing.

When the image formation is still being executed and the timing of the DEV output has not ended (S14: N), in S15, similarly to the S3, after the processing waits for a given period of time, the processing advances to S11. Subsequently, the processing in S11 to S15 is carried out repeatedly, and while adjusting the PWM value so as to attain DEVO=V1, the DEV output remains on. When it is judged that the timing of the DEV output has ended (S14: Y) in S14, the DEV output is stopped in S16 and the processing ends.

As described above, according to the aspect of the invention, with the use of a simple structure including only the detect electrode 710 and resistors 731, 732 as additional parts, the control for maintaining the developing bias at V1 (S11, S12) can be carried out simultaneously with the control for notifying such abnormal condition and stopping the output when an abnormal condition such as poor contact occurs (S5, S6). Therefore, in the laser printer 1 according to an aspect of the invention, not only the manufacturing cost thereof can be restricted but also good image formation can be achieved.

Also, according to the aspect of the invention, the electric potential detected through the detect electrode 710 is converted to a digital value DEVO and the control is carried out by the single control part 800 using a software process. This can further simplify the structure of the laser printer and can also further reduce the manufacturing cost thereof. Further, according to the aspect of the invention, when an abnormal condition such as poor contact occurs (S5: N), an error message is displayed on the display portion 210 and the DEV output is also stopped (S6). This can urge a user to take proper measures and can also prevent the occurrence of poor image formation.

Figure 14A:
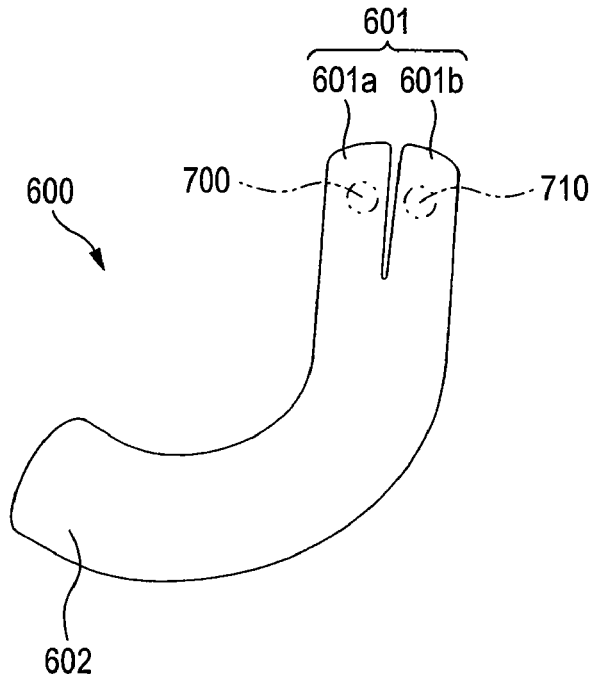
FIGS. 14A and 14B are explanatory views of another aspect of an electrode member.

Incidentally, the invention is not limited to the above-described aspect at all but it can be enforced in other various aspects without departing from the subject matter or scope of the invention. For example, one end 601 of the electrode member 600, as shown in FIG. 14A, may also be branched to a contact portion 601*a* to be contacted with the drive electrode 700 and a contact portion 601*b* to be contacted with the detect electrode 710. In this case, the contact portion 601*b* constitutes a second electrode.

Figure 14B:
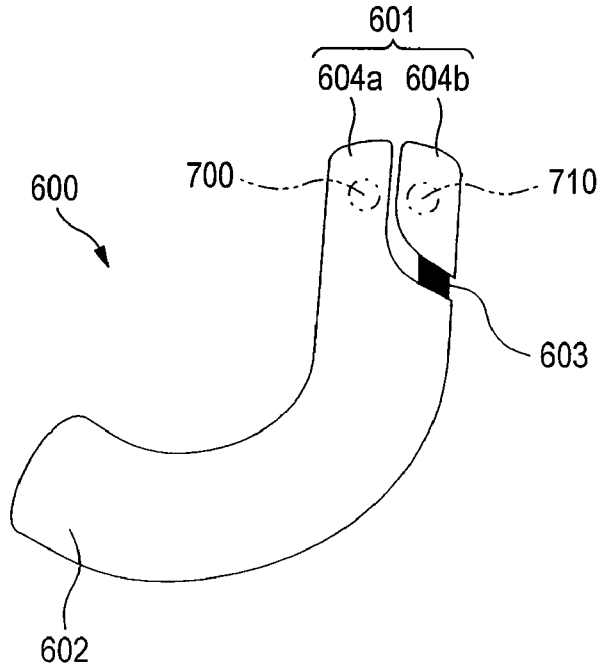
Figure 15:
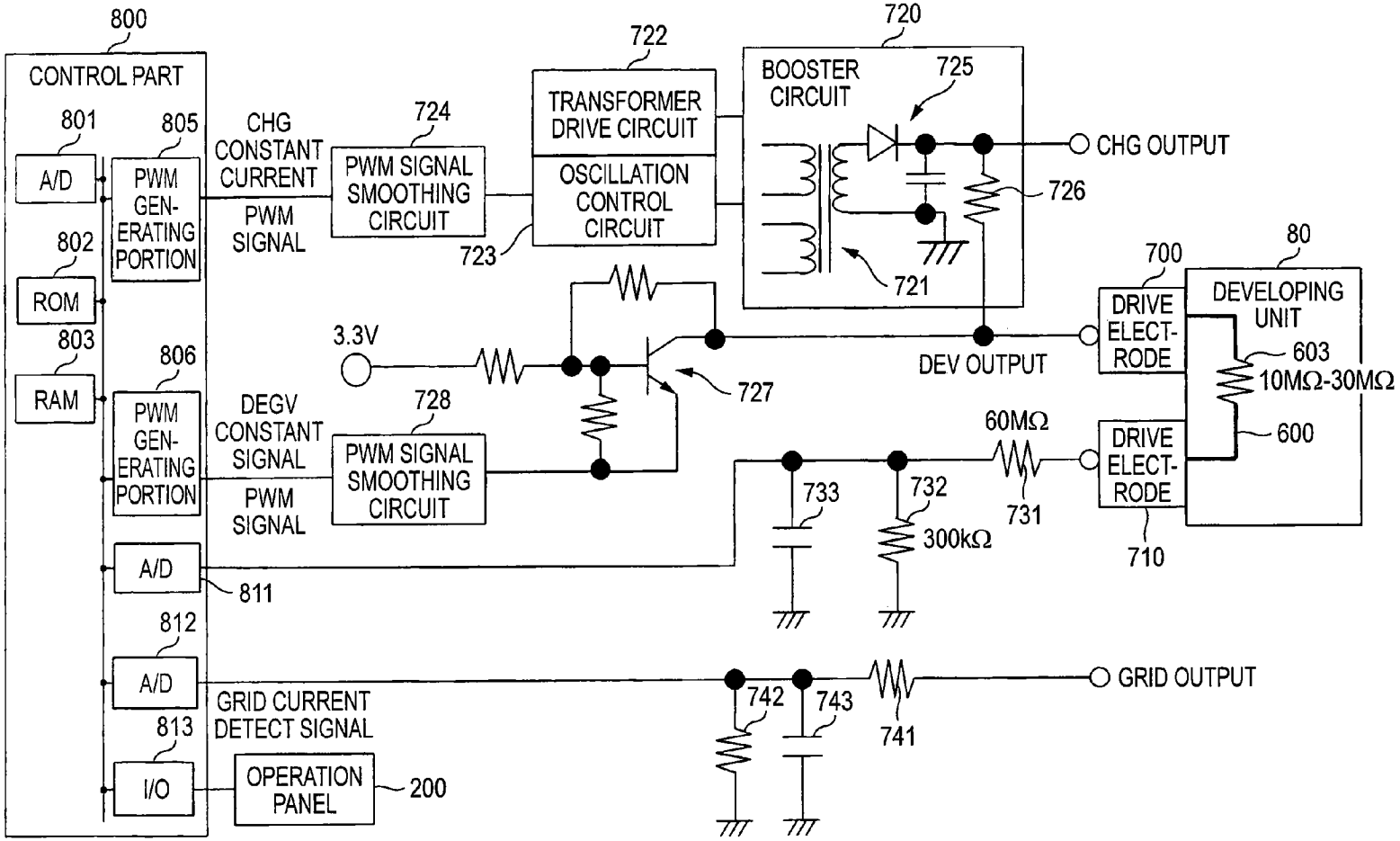
FIG. 15 is a schematic block diagram of the structure of an electric system used in another aspect of the invention.

Also, as shown in FIG. 14B, a contact portion 604*b* to be contacted with the detect electrode 710 may be formed as another electrode which is separate from a contact portion 604*a* to be contacted with the drive electrode 700, while these two contact portions 604*a* and 604*b* may be electrically connected to each other through a resistor component 603. In this case, the contact portion 604*b* constitutes the second electrode. FIG. 15 is a schematic block diagram of the structure of an electric system employed in another aspect of the invention. As shown in FIG. 15, assuming that the resistance value of the resistor component 603 is set for 10 MΩ to 30 MΩ, an electric potential to be input to the A/D converter 811 is a value obtained by multiplying the electric potential of the detect electrode 710 by 0.004 to 0.003. Therefore, according to this aspect, by setting the resistance value of the resistor component 603 according to the kind of toner used, there can be provided the following desirable effects.

That is, the proper value of the developing bias can vary according to the kind of toner used. However, even in this case, when the resistance value of the resistor component 603 is previously set according to a particular kind of toner, without changing parameters such as the V1, the value of the developing bias can be controlled to be optimum with respect to the respective kinds of toners.

In this aspect, the image forming portion 7 corresponds to an image forming unit, the developing unit 80 (developing cartridge 40+toner cartridge 60) corresponds to an image forming cartridge, the electrode member 600 and drive electrode 700 correspond to a drive electrode, the booster circuit 720 and drive circuit 727 correspond to a power supply, the resistor 732 corresponds to a resistor unit, the processing of S11, S12 and control part 800 correspond to a control unit, the processing of S5 and control part 800 correspond to an abnormal condition detect unit, the A/D converter 811 corresponds to a conversion unit, the control part 800 corresponds to a processing unit, and the processing of S6 and control part 800 correspond to a stop unit and a notify unit, respectively.

Further, the aspects of the invention can apply to various image forming apparatus of an electrophotographic type such as a copying machine, a facsimile machine, and a color laser printer. The image carrier may be a sensitive belt or may be another image carrier other than a sensitive member. Also, the aspects of the invention can also apply to an image forming apparatus which includes a so-called intermediate transfer belt. Especially, when the aspect of the invention shown in FIGS. 14B and 15 is applied to a color laser printer, even if the proper value of the developing bias varies according to the respective colors of toners, this fluctuation is managed with by using the same software.

Also, in the aspects, description has been given of an example in which the sensitive cartridge 20 and developing cartridge 40 can be structured such that they can be separated from each other. However, they may also be structured as an integrated cartridge that cannot be separated into separate parts. In this case, the whole of the integrated cartridge corresponds to the image forming cartridge.

What is claimed is:

1. An image forming apparatus, comprising:

an image forming unit which forms an image electrophotographically;

an image forming cartridge which constitutes at least a part of the image forming unit and is removably installable to an image forming apparatus main body;

a pair of drive electrodes respectively provided in the image forming apparatus main body and the image forming cartridge, the pair of drive electrodes being in contact with each other so as to allow a bias voltage to be supplied from the image forming apparatus main body to the image forming cartridge when the image forming cartridge is mounted on the image forming apparatus main body;

a power supply which is provided in the image forming apparatus main body and applies a voltage to the drive electrode provided in the image forming apparatus main body;

a detect electrode which is provided in the image forming apparatus main body separately from the drive electrode of the image forming apparatus main body, the detect electrode being in contact with at least one of the drive electrode of the image forming cartridge and a second electrode on the image forming cartridge which is electrically connected to the drive electrode of the image forming cartridge when the image forming cartridge is mounted on the image forming apparatus main body;

a resistor connected to the detect electrode;

a voltage measurement unit which measures a terminal voltage of the resistor;

a first control unit which controls an output of the power supply based on the terminal voltage of the resistor; and a second control unit which detects an abnormal condition of the image forming cartridge based on the terminal voltage of the resistor measured by the voltage measurement unit.

2. The image forming apparatus according to claim 1, wherein the resistor is interposed between the detect electrode and the second control unit.

3. The image forming apparatus according to claim 1, further comprising:

a conversion unit which converts the terminal voltage of the resistor to a digital value; and a common processing unit which constitutes the first control unit and the second control unit, wherein the first control unit controls the output of the power supply based on the terminal voltage of the resistor converted to the digital value by the conversion unit, and wherein the second control unit detects the abnormal condition based on the terminal voltage of the resistor converted to the digital value by the conversion unit.

4. The image forming apparatus according to claim 1, further comprising a stop unit which stops operation of the image forming apparatus main body when the second control unit detects the abnormal condition of the image forming cartridge.

5. The image forming apparatus according to claim 1, further comprising a notify unit which provides a notification of the abnormal condition of the image forming cartridge.

6. The image forming apparatus according to claim 1, wherein the image forming cartridge comprises the second electrode and the drive electrode, the second electrode being separate from the drive electrode, and wherein the second electrode and the drive electrode of the image forming cartridge are electrically connected to each other through a resistor component.

7. The image forming apparatus according to claim 1, wherein the image forming cartridge comprises a developing unit which develops an electrostatic latent image formed on an image carrier of the image forming unit using a developer, and wherein a bias voltage supplied through the pair of drive electrodes is applied to the developing unit.

* * * * *